US005417155A

United States Patent [19]

Tatsuzawa et al.

[11] Patent Number: 5,417,155

[45] Date of Patent: May 23, 1995

[54] COUNTER-ROTATION TWIN-SCREW EXTRUDER FOR EXTRACTING JUICE

[75] Inventors: Hirohisa Tatsuzawa; Takahiro Inakuma; Yukio Ishiguro, all of Tochigi; Toshio Yamamoto; Shigeo Kanou, both of Mie, all of Japan

[73] Assignees: Kagome Kabushiki Kaisha, Aichi; Suehiro Epm Corp., Mie, both of Japan

[21] Appl. No.: 166,474

[22] Filed: Dec. 14, 1993

[30] Foreign Application Priority Data

Dec. 22, 1992 [JP] Japan ..... 4-357110

[51] Int. Cl.[6] ..... B30B 9/16

[52] U.S. Cl. ..... 100/127; 100/112; 100/117; 100/146

[58] Field of Search ..... 100/112, 117, 126, 127, 100/128, 129, 146

[56] References Cited

U.S. PATENT DOCUMENTS

| | | | |
|---|---|---|---|
| 2,360,984 | 10/1944 | Schmitz, Jr. | 100/146 |
| 2,567,219 | 9/1951 | Lesniak | 100/146 |
| 3,450,034 | 6/1969 | Ocler | 100/127 X |
| 3,780,645 | 12/1973 | Farmer | 100/117 |
| 4,214,947 | 7/1980 | Berger | 100/146 X |
| 4,393,983 | 7/1983 | Eriksson | 100/146 X |
| 4,705,055 | 11/1987 | Rohm et al. | 100/117 X |

FOREIGN PATENT DOCUMENTS

| | | | |
|---|---|---|---|
| 517970 | 5/1921 | France | 100/126 |
| 2620543 | 11/1977 | Germany | 100/127 |
| 275489 | 6/1930 | Italy | 100/127 |

*Primary Examiner*—Stephen F. Gerrity
*Attorney, Agent, or Firm*—Heller, Ehrman, White & McAuliffe

[57] ABSTRACT

A counter-rotation twin-screw extruder for extracting a juice by squeezing vegetables and/or fruits has mutually engaging screws mounted to two mutually parallel rotary shafts which rotate in mutually opposite directions. The screws are enclosed inside a screen structure made of a curved member made of a stainless steel plate and having slits through which juice is collected.

10 Claims, 3 Drawing Sheets

COUNTER-ROTATION TWIN-SCREW EXTRUDER FOR EXTRACTING JUICE

BACKGROUND OF THE INVENTION

This invention relates to a counter-rotation twin-screw extruder for extracting a juice by squeezing vegetables and/or fruits. Extruders for such a purpose can generally be divided into a single-screw rotary type and a twin-screw rotary type. Twin-screw rotary extruders are mainly used for extracting edible oil from sesame seeds and may be further divided into co-rotation twin-screw extruders and counter-rotation twin-screw extruders. This invention relates more particularly to a counter-rotation twin-screw extruder used for extracting a juice from vegetables and/or fruits.

Examples of conventional twin-screw rotary extruder include co-rotation twin-screw extruders having screws mounted to two shafts adapted to rotate in the same direction as described in U.S. Pat. No. 3,450,034 and counter-rotation twin-screw extruders having screws mounted to two shafts adapted to rotate in opposite directions as described in Japanese Patent Publication Tokkai 2-251397. They are both provided with a plurality of tubular plates serving as an enclosure for a pair of mutually engaging parallel screws and a plurality of spacers disposed between these tubular plates such that gaps, or slits, are formed where there are no spacers between the tubular plates. When they are used for extracting edible oil, soybeans or oil-containing seeds such as sesame seeds are compressed between the parallel screws which are in mutually engaged relationship, and the oil thus extracted is collected through the slits formed between the plurality of tubular plates.

If these conventional twin-screw rotary extruders are directly used to extract a juice from vegetables and/or fruits, however, problems of the following kinds are encountered:

(1) For extracting edible oil from sesame seeds, a rotary extruder must be operated at a fairly high pressure because of the nature of the substance. Accordingly, the slits must be structured so as to withstand high pressures. In other words, the enclosure formed by tubular plates and spacers must be thick, and this makes the extruder excessively heavy.

(2) If the thickness of the tubular plates is increased, the slits formed therebetween become deeper (in the radial direction) and the volume of the gaps correspondingly larger. Since unwanted voids are also created inevitably between the tubular plates and the spacers, the juice of vegetables and/fruits is easily contaminated with bacteria due to these gaps and voids.

(3) Since the tubular plates and the spacers are affixed to the body of the extruder by way of through-bolts, it is difficult to disassemble the extruder for cleaning so as to prevent contamination as much as possible.

SUMMARY OF THE INVENTION

The present invention was accomplished in order to solve these problems of conventional twin-screw rotary extruders which are too heavy, tend to cause contamination of the juice and are difficult to clean for preventing bacterial contamination.

A counter-rotation twin-screw extruder embodying the present invention, with which the above and other objects can be accomplished, may be characterized as having screws mounted to two counter-rotating shafts and a screen formed of a curved stainless plate surrounding the screws and having a plurality of slits therethrough. It is intended to be used for extracting a juice by squeezing vegetables and/or fruits, examples of vegetables including tomatoes, carrots, cabbages and celeries and examples of fruits including apples, tangerines and grapes. Depending on the kind of vegetables or fruits, it is to be understood that they may be required to be peeled and/or the cores be already removed therefrom. In some situations, two or more kinds may be processed at the same time.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
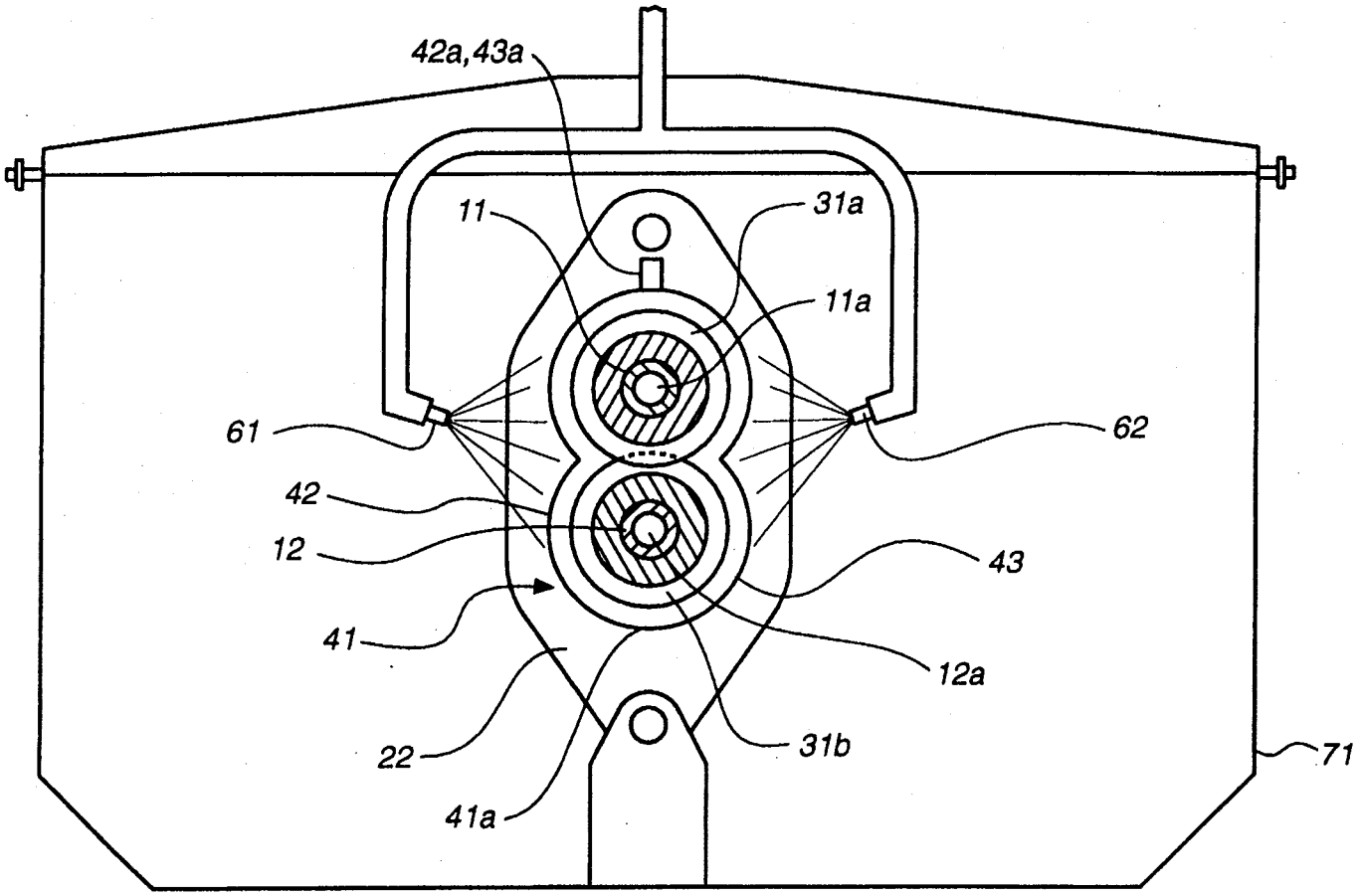
FIG. 1 is a sectional front view of an extruder according to a first embodiment of the invention.
Figure 2:
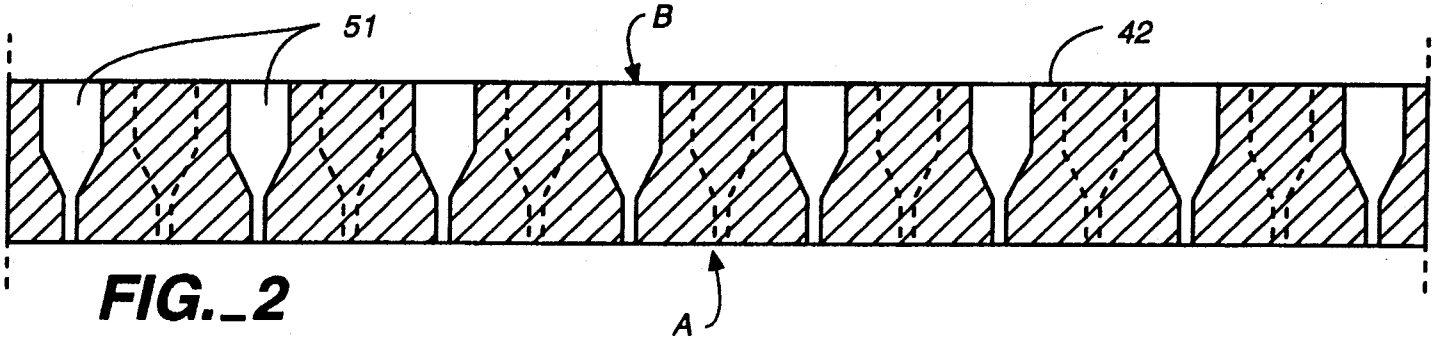
FIG. 2 is a sectional side view of a portion of the screen structure for the extruder shown in FIG. 1.
Figure 3:
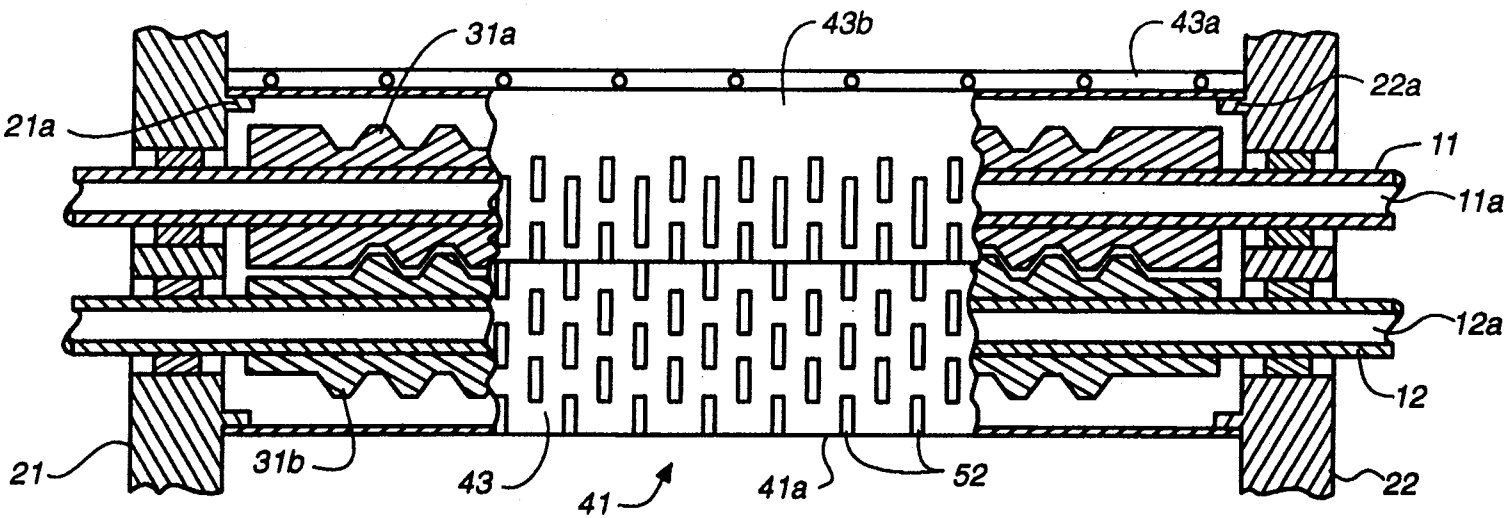
FIG. 3 is a schematic partially sectional side view of a portion of the extruder of FIG. 1.

As shown in FIGS. 1, 2 and 3, a counter-rotation twin-screw extruder according to a first embodiment of the invention for extracting a juice by squeezing vegetables and/or fruits is provided with two rotary shafts 11 and 12 extending mutually parallel to each other, one above the other in two levels, and axially supported by outer frame structures 21 and 22 respectively in front and at back thereof so as to be able to rotate in mutually opposite directions. Each of these shafts 11 and 12 has a longitudinally extending hollow interior 11*a* or 12*a* such that a heating medium, such as steam, can be passed therethrough. Although not shown in the figures, the shafts 11 and 12 are engaged with each other outside the outer frame structure 22 and also connected to a driving motor through a decelerator for causing deceleration.

Two mutually engaging forward screws 31*a* and 31*b* are mounted respectively to the rotary shafts 11 and 12 and are surrounded by a screen structure 41 comprised of two curved members 42 and 43 which are connected together by a hinge 41*a*. Each of the curved members 42 and 43 is made of a plate of stainless steel through which a plurality of slits 51 or 52 are provided in radial directions and is supported also by the outer frame structures 21 and 22 in front and at back. The two curved members 42 and 43 are shaped and connected together such that the screen structure 41 has an overall cross-sectional shape of numeral "8" longitudinally, as seen best in FIG. 1. Their front and back ends are adapted to engage from outside with annular flange parts 21*a* and 22*b* protruding from the outer frame structures 21 and 22, respectively. The curved members 42 and 43 are also provided at their front and back ends with radially extending pieces 42*a* and 43*a* which are fastened together by bolts.

The slits 51 and 52 are formed through the curved members 42 and 43 such that they become wider towards the outer circumferential surface (indicated by arrow B in FIG. 2) than towards the inner surface (indicated by arrow A in FIG. 2). It is for preventing pulp-like remains of squeezed vegetables and/or fruits from clogging the slits 51 and 52 as juice is collected outward therethrough from the interior of the curved members 42 and 43. As shown both in FIGS. 2 and 3, these slits are distributed in a longitudinally staggered (or zigzag) manner in order to increase the overall strength of the screen structure 41. They are formed on side and bottom portions of the members 42 and 43, but not on the ceiling part 43*b*. It is because the pulp-like substances clogging the slits on side and bottom portions of the members 42 and 43 can be removed relatively easily by a water spray but those clogging slits on ceiling parts are difficult to remove by such means.

As shown in FIG. 1, a plurality of nozzles 61 and 62 are arranged longitudinally on both sides of the screen structure 41 surrounding the mutually engaging forward screws 31*a* and 31*b*. The rotary shafts 11 and 12, the forward screws 31*a* and 32*a* and the screen structure 41 are all placed inside a tank 71. Although not shown in the figures, an inlet for vegetables and/or fruits to be squeezed and an outlet for their remains after the are squeezed are provided, penetrating both the tank 71 and the screen structure 41. The inlet is located near the outer frame structure 21 and the outlet is near the other outer frame structure 22. The juice which has been extracted is temporarily stored inside the tank 71 and then transported away.

Figure 4:
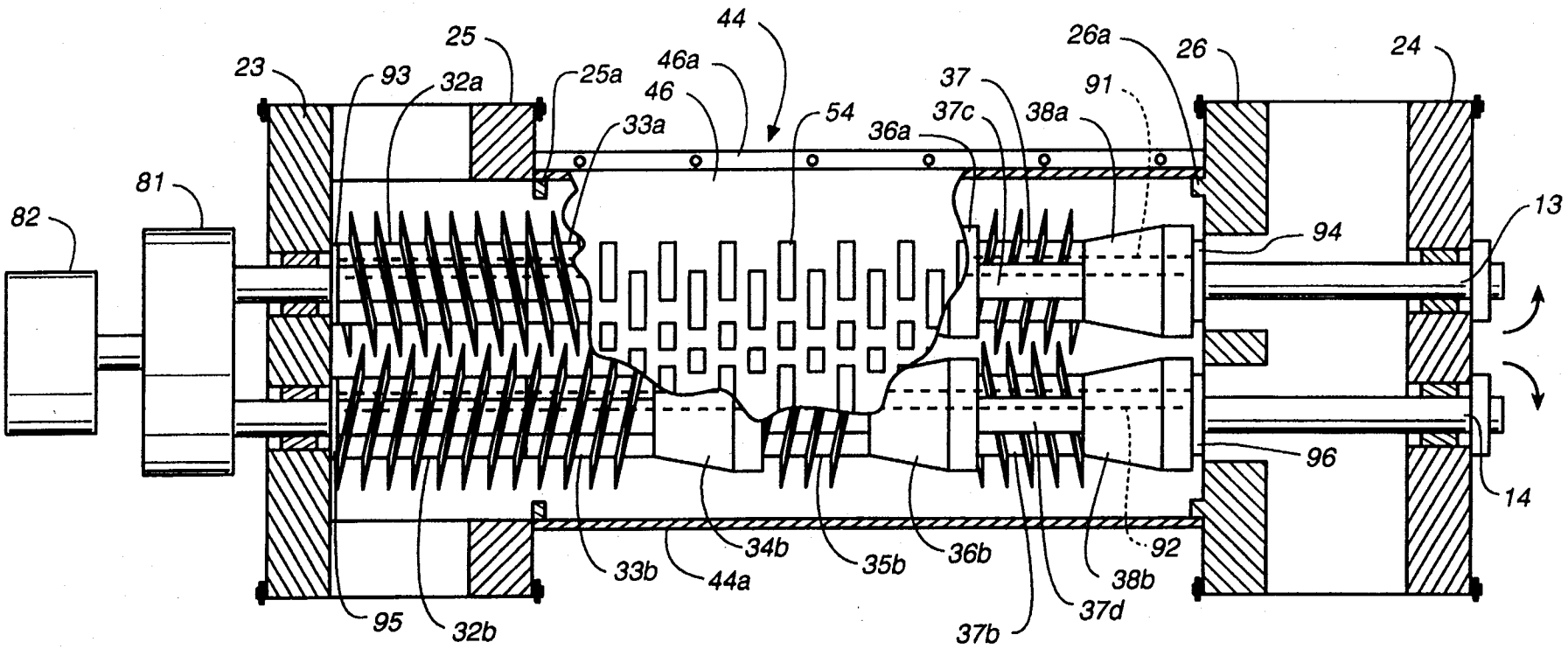
FIG. 4 is a partially sectional side view of another extruder according to a second embodiment of the invention.

FIG. 4 shows another extruder according to a second embodiment of the invention which also comprises two rotary shafts 13 and 14 extending mutually parallel to each other, one above the other in two levels, and axially supported by outer frame structures 23 and 24 respectively in front and at back thereof so as to be able to rotate in mutually opposite directions. These two shafts 13 and 14 are shown engaged to each other outside the outer frame structure 23 and are connected through a decelerator 81 to a driving motor 82. Inner frame structures 25 and 26 are provided inside the outer frame structures 23 and 24, respectively, and a mutually corresponding pair of a series of screws and other components are mounted to the two shafts 13 and 14 between the outer frame structure 23 and the inner frame structure 26. The screws and other components in the series are arranged continuously as follows from the side of the outer frame structure 23 to the inner frame structure 26: forward screw 32*a* or 32*b*→forward screw 33*a* or 33*b*→tapered collar 34*a* or 34*b*→forward screw 35*a* or 35*b*→tapered collar 36*a* or 36*b*→reverse screw 37*a* or 37*b*→tapered collar 38*a* or 38*b* (the tapered collar 34*a* and forward screw 35*a* being not visible in FIG. 4). The screws and other components on one shaft each engage with the corresponding screw or other component on the other shaft.

The forward screws and the reverse screws in the series are all parallel screws. The circumferential surfaces of the forward screws are provided with helical grooves such that the rotary motion of the shafts 13 and 14 will tend to push the crushed and chopped objects towards the inner frame structure 26. The circumferential surfaces of the reverse screws 37*a* and 37*b* are provided with helical grooves such that the rotary motion of the shafts 13 and 14 will tend to push the crushed and chopped objects back towards the outer frame structure 23. The circumferential surfaces of the reverse screws 37*a* and 37*b* are also each provided with a few longitudinally extending passage regions 37*c* and 37*d* with no thread ridges such that the remains of squeezed vegetables and/or fruits, from which juice has already been extracted by the time they reach the position of the reverse screws 37*a* and 37*b*, can be pushed therethrough towards the tapered collars 38*a* and 38*b*. The circumferential surfaces of the tapered collars are formed so as to gradually expand towards the inner frame structure 26.

The shafts 13 and 14 and the screws are formed with indentations into which columnar stopper pieces 91 and 92 are inserted. Inner surfaces of the outer frame structure 23 and the inner frame structure 26 are threaded, and stopper rings 93–96 are fastened thereto. These stopper pieces 91 and 92 and stopper rings 93–96 serve to removably position the screws on the two shafts 13 and 14.

Between the two inner frame structures 25 and 26, the screws and other components on the two shafts 13 and 14 are enclosed inside a screen structure 44. The screen structure 44 is formed (like the corresponding screen structure shown at 41 in FIGS. 1 and 3) with two curved stainless steel plates 45 and 46 (the plate 45 being behind the plate 46 and hence not visible), which are mounted to the inner frame structures 25 and 26 and formed with a plurality of slits 53 and 54 therethrough (the slits 53 being behind the plate 46 and hence not visible). Seen in the longitudinal direction, the screen structure 44 has an overall cross-sectional shape of numeral "8" as seen in FIG. 1. Flange sections 25*a* and 26*a* are provided to the inner frame structures 25 and 26, respectively, for engaging the screen structure 44 therearound. Symbol 46*a* indicates one of a pair of pieces extending from peripheries of the curved plates 45 and 46 to be fastened together by bolts.

In other respects, the extruder shown in FIG. 4 is structured similarly to the one shown in FIGS. 1, 2 and 3, except the inlet (not visible) for vegetables and/or fruits to be squeezed is provided between the outer and inner frame structures 23 and 25, and the outlet (not visible) for their remains after they are squeezed is provided between the outer and inner frame structures 24 and 26.

Although the invention has been described above with reference to only two embodiments, they are not intended to limit the scope of the invention but to be interpreted as merely being illustrative. Many modifications and variations are possible within the scope of the invention. For example, the two shafts may be arranged in two rows in a horizontal plane. Screws and components of various kinds may be mounted to the shafts in different sequences such as: forward screw→forward screw→tapered collar→forward screw→tapered collar→tapered collar→tapered collar, although it is preferable to include reverse screws in the sequence. If reverse screws are to be included in the sequence, however it is preferred that the reverse screws be closer to the outlet side than to the inlet side because the rate of obtaining juice from vegetables and/or fruits can be thereby increased.

The stainless steel plates forming the screen structure may be as thin as about several millimeters. The screen structure need not be formed with two curves plates hinged together. It may be a unistructural piece formed, for example, by opening a plurality of slits through a stainless steel plate. cutting and/or polishing it and bending it completely around. In other words, the manner in which the screen structure is formed does not limit the invention.

In summary, extruders according to the present invention are significantly lighter than conventional extruders of a comparable type because the screen structure is made of stainless steel plates of thickness only several millimeters, unlike tubular plates of thickness several centimeters which were conventionally used together with many spacers placed therebetween. Since internal gaps and voids can be eliminated because of the nature of the structure made possible by the invention, the juice extracted from vegetables and/or fruits, which are basically perishable commodities, is less likely to become contaminated bacterially. Still another advantage of the extruders according to the invention is that they can be assembled, disassembled and washed more easily than conventional extruders.

What is claimed is:

1. A counter-rotation twin-screw extruder comprising:

two elongated rotary shafts extending in a forward direction parallel to each other and adapted to rotate in mutually opposite directions, each of said shafts having mounted thereto at least a forward screw for pushing objects in said forward direction therealong, a tapered collar and a reverse screw for pushing objects in a backward direction therealong opposite said forward direction, the forward screws on said two shafts engaging each other, the reverse screws on said two shafts engaging each other, each of said reverse screws having at least one passage region formed parallel to said shafts and having no thread ridges therein; and a screen structure enveloping said screws therein, said screen structure comprising a curved member made of a stainless steel plate, said curved member having an outer surface, an inner surface and a plurality of slits formed therethrough transversely to the longitudinal axes of said shafts and connecting said outer and inner surfaces, said screen structure having an inlet and an outlet, said outlet being in said forward direction from said inlet, said reverse screws being formed closer to said outlet than to said inlet.

2. The extruder of claim 1 wherein said slits are wider near said outer surface than near said inner surface.

3. The extruder of claim 2 wherein said slits are distributed in a staggered zigzag way on said curved member.

4. The extruder of claim 3 wherein said slits are formed over said curved member except a ceiling part of said curved member.

5. The extruder of claim 4 further comprising a tank containing said screen structure therein.

6. The extruder of claim 3 further comprising a tank containing said screen structure therein.

7. The extruder of claim 1 wherein said slits are distributed in a staggered zigzag way on said curved member.

8. The extruder of claim 7 wherein said slits are formed over said curved member except a ceiling part of said curved member.

9. The extruder of claim 8 further comprising a tank containing said screen structure therein.

10. The extruder of claim 7 further comprising a tank containing said screen structure therein.

* * * * *